United States Patent [19]

Sherman

[11] 4,193,839

[45] Mar. 18, 1980

[54] FLOW CONTROL METHOD AND APPARATUS FOR CONTINUOUS WOOD CHIP DIGESTER SCREENLESS LIQUOR EXTRACTOR

[75] Inventor: Michael I. Sherman, Glens Falls, N.Y.

[73] Assignee: Kamyr, Inc., Glens Falls, N.Y.

[21] Appl. No.: 685,391

[22] Filed: May 11, 1976

[51] Int. Cl.[2] ..... D21C 7/14

[52] U.S. Cl. ..... 162/19; 162/41; 162/42; 162/60; 162/237; 162/248; 162/249; 162/251

[58] Field of Search ..... 162/237, 248, 249, 251, 162/17, 19, 41, 42, 43, 60; 8/156; 68/181 R; 210/345

[56] References Cited

U.S. PATENT DOCUMENTS

| | | | |
|---|---|---|---|
| 2,828,017 | 3/1958 | Ronningon et al. | 210/345 |
| 3,268,923 | 8/1966 | Burling | 8/156 |
| 3,298,899 | 1/1967 | Laakso | 162/19 |
| 3,434,920 | 3/1969 | Green | 162/237 |
| 3,814,664 | 6/1974 | Carlsmik | 162/237 |
| 3,941,650 | 3/1976 | Schnyder | 162/237 |
| 3,985,005 | 10/1976 | Leffler | 68/181 R |
| 3,992,248 | 11/1976 | Hurter | 162/17 |

FOREIGN PATENT DOCUMENTS 2361627 6/1974 Fed. Rep. of Germany .

*Primary Examiner*—William F. Smith

*Attorney, Agent, or Firm*—Cushman, Darby & Cushman

[57] ABSTRACT

A method and apparatus for screenless treatment of cellulose fiber material without channeling of treatment liquid through a fiber material column being treated. An inner vertical vessel extends into an outer vertical vessel which has a larger diameter than the inner vessel, and an annular space in the outer vessel is defined by a portion of the inner vessel extending into the outer vessel. At least three baffles extend through the annular space into the area of the outer vessel below the inner vessel to define at least three distinct flow areas, and an outlet nozzle is provided in each of the flow areas. Liquid is withdrawn from the annular space through at least two of the flow areas, while liquid is backflushed into one of the flow areas.

15 Claims, 2 Drawing Figures

FLOW CONTROL METHOD AND APPARATUS FOR CONTINUOUS WOOD CHIP DIGESTER SCREENLESS LIQUOR EXTRACTOR

BACKGROUND AND SUMMARY OF THE INVENTION

The invention relates to a method and apparatus for screenless treatment of fiber material, such as digesting of fiber material in a continuous digester, and to a means and method for preventing the channeling of fiber material treating liquid in a continuous digester or the like. Screenless treatment of fiber material per se has been disclosed in U.S. patent application Ser. Nos. 423,812, filed Dec. 11, 1973 abandoned; 592,659, filed July 2, 1975 U.S. Pat. No. 4,028,171; 613,554, filed Sept. 15, 1975 abandoned; and 659,638, filed Feb. 20, 1976 U.S. Pat. No. 4,061,193, and while such fiber material treatment is generally successful, sometimes problems can arise with respect to the treatment liquid forming channels in flowing through the fiber material, and going directly to the outlet without evenly and uniformly treating and/or heating the fiber material. According to the present invention, channeling of liquid through the fiber material column has been substantially eliminated while screenless treatment is still practiced.

According to the present invention, apparatus for the treatment of cellulose fiber material is provided, including an inner vertically extending vessel having a diameter D, and an outer vertically extending vessel having a diameter E (wherein E is larger than D). A bottom portion of the inner vessel extends into the outer vessel and defines an annular space in the outer vessel between the inner vessel and the outer vessel. Means for introducing fiber material treating liquid into a column of fiber material in the outer vessel is provided, such as a pipe extending into the outer vessel a distance J wherein J is $\frac{1}{2}$E, and means (including a pump) are provided for withdrawing liquid introduced into the column in the outer vessel from the annular space to an area remote from the vessels. The means for preventing channeling of liquid through the column include at least three vertically extending baffles disposed in the annular space and partitioning it into at least three distinct flow areas, an outlet nozzle associated with each flow area, and means for operatively connecting each of the outlet nozzles to the liquid withdrawing means. Also, means are provided for backflushing one of the flow areas while withdrawal of liquid takes place through the other areas to clean the flow area of material and to insure future no-channeling flow therethrough, and the flow area that is backflushed is continuously changed.

Also, according to the present invention, a method for treating cellulose fiber material is provided utilizing an inner vertically extending vessel having a diameter D and an outer vertically extending vessel having a diameter E greater than D, and a bottom portion of the inner vessel extending into the outer vessel and defining an annular space in the outer vessel between the inner vessel and the outer vessel. According to the method of the invention, cellulose fiber material is passed through the inner vessel into the outer vessel to establish a column of cellulose fiber material extending downwardly from the bottom portion of the inner vessel. Cellulose fiber treating liquid, such as digesting liquor, is introduced into the material column. At least three distinct flow areas of fiber material treating liquid through the fiber column to the annular space are established, at least two of the three distinct flow areas having liquid flowing therethrough from the column through the annular space so that channeling of liquid flow through the column does not take place. Liquid is withdrawn from the annular space in the outer vessel at a rate relative to the dimensions of the vessel such that a stilling well effect is created in the annular space and fiber material from the column is not entrained in liquid flow in the annular space, and so that no screening of the liquid flow is necessary. Liquid is forced back into the annular space through one of the flow areas while the withdrawal of liquid takes place through at least two flow areas, and the flow area that liquid is forced back into is continuously switched.

It is the primary object of the present invention to provide a method of and apparatus for the screenless treatment of cellulose fiber material without channeling of treatment liquid. This and other objects of the invention will become clear from an inspection of the detailed description of the invention, and from the appended claims.

DETAILED DESCRIPTION OF THE INVENTION

Figure 1:
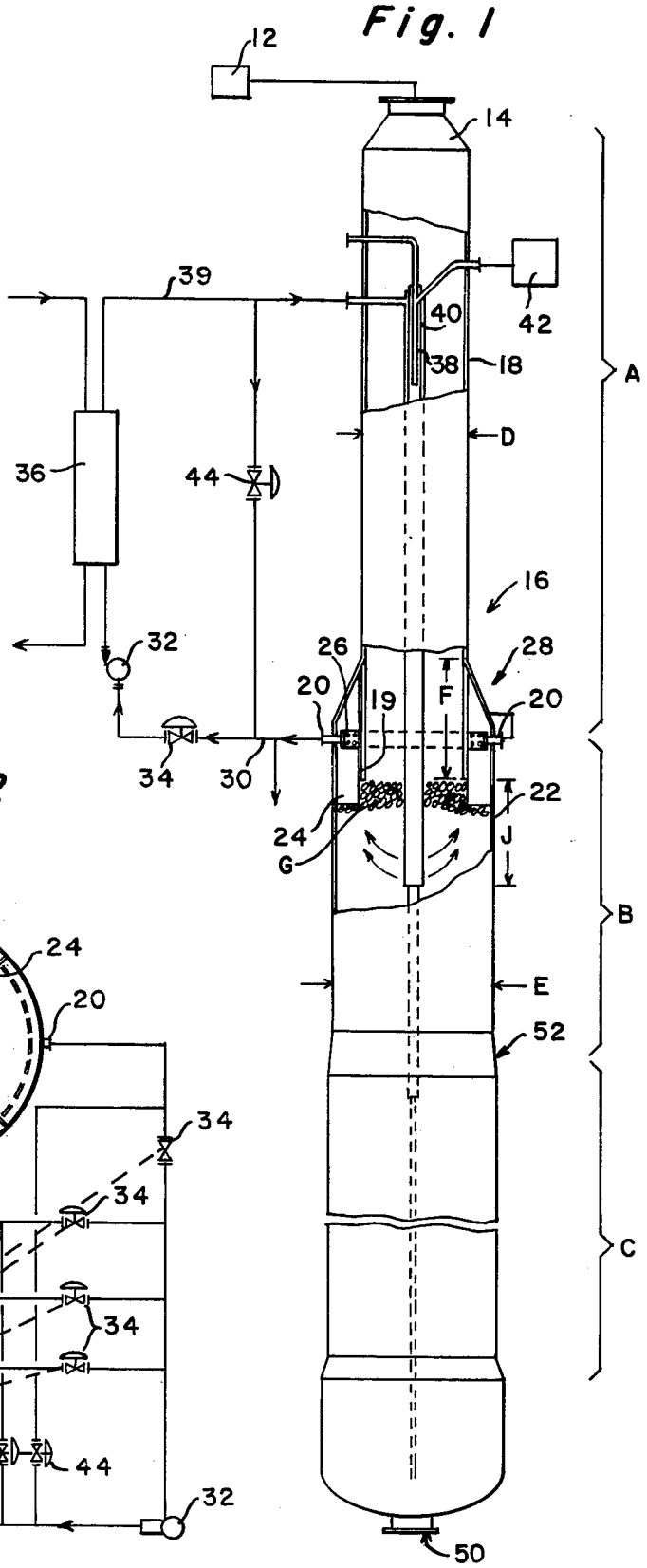
FIG. 1 is a schematic view, partly in cross-section and partly in elevation, of an exemplary assembly according to the present invention that provides for screenless digesting without channeling.

An exemplary continuous digester and associated assemblies according to the present invention are shown generally at 10 in FIG. 1. The assembly 10 includes a conventional steaming vessel 12 or the like from which wood chips or like cellulose fiber material is fed to a conventional digester inlet or charging means 14. The charging means 14 feeds cellulose material entrained in digesting liquid into a first impregnation zone A of the digester 16, wherein the cellulose material is impregnated with digesting liquid at a relatively low temperature. The impregnation zone A is defined by an inner cylindrical vessel 18 having a diameter D. It is preferred that the impregnation vessel 18 taper slightly outwardly in the downward direction to facilitate the downward movement of wood chips or like cellulose material therein. The vessel 18 has a lower portion 19 thereof which extends downwardly into the digesting zone B of digester 16 a distance F, the bottom of the lower portion 19 being well below the liquid outlet nozzles 20 in the digesting zone B, as will be hereinafter further explained.

Figure 2:
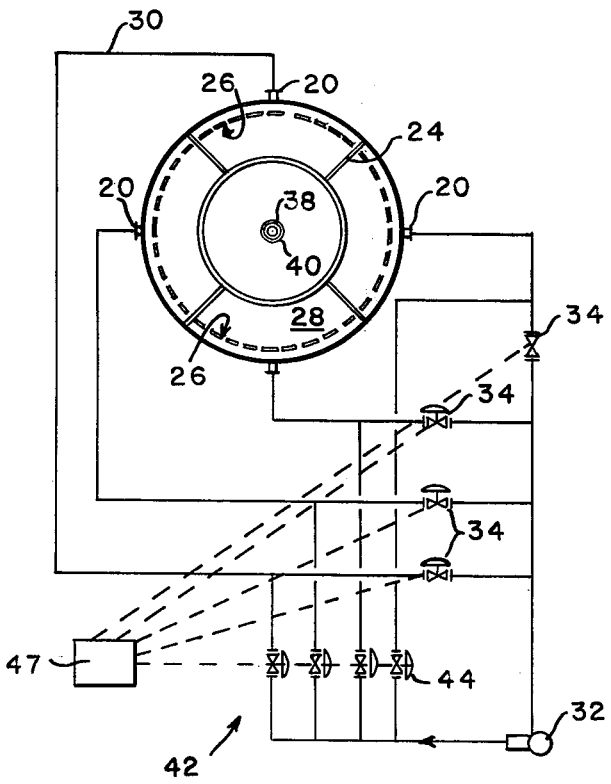
FIG. 2 is a top view of particular channeling preventing means of the assembly of FIG. 1 taken along lines 2—2 of FIG. 1.

The digesting zone B and subsequent treatment zone C are defined by an outer vessel 22 having a diameter E significantly greater than the diamater D of the impregnation vessel 18. Around the periphery of an upper portion of the vessel 22 (in annular space 28), significantly above the bottom of the lower portion 19 of the impregnation vessel 18, there are provided three or more liquid outlet nozzles 20, and a number of baffles 24 equal to the number of outlet nozzles 20. An extraction plate or plates 26, which are together essentially circumferentially continuous as shown in FIG. 2, interrupted only by the baffles 24, are provided in front of the nozzles 20. The plates 26 are perforated, with each of the perforations in the order of ¾", and the plates may be about one foot high. The plates 26 are not screens as in conventional digesters (screen openings being approximately ¼"), but rather merely serve to keep large floatables from passing into the outlet nozzles 20, which could damage the equipment disposed in communication with the liquid outlet nozzles 20. The baffles 24 extend downwardly from a top portion of the outer vessel 22 past the bottom portion 19 of the inner vessel 18 into the chip mass in the vessel 22. The baffles 24 direct liquid flow in the annular space 28 between the vessel 22 and the lower portion 19 of vessel 18 by providing flow areas. All the liquid flowing into each of the nozzles 20 must flow between a pair of baffles 24 on either side of the nozzle 20, and suction is provided for a plurality of nozzles 20, and thus even distribution of liquid through the chip mass into the outlet nozzles 20 is facilitated.

Each outlet nozzle 20 is connected to an outlet line 30, a pump 32 being disposed in communication with outlet lines 30 to provide for suction of the liquid through the nozzles 20. Disposed in each line 30 between each nozzle 20 and the pump 32 is a remotely controlled valve 34 for selectively either allowing or preventing flow of liquid from the nozzle 20 with which the valve is associated to the pump 32. From pump 32 the spent digesting liquid is passed into heater 36 or the like, wherein it is recharged, and then it is recirculated back to the digester 16 for further treatment of other cellulose material. Inlets for the hot digesting liquid may be provided by any suitable structure, such as conventional concentric inlet pipes 38, 40, the pipe 38 being operatively associated with the line 39 leading from heater 36, and the pipe 40 leading from a source 42 of digesting liquid. In order to facilitate proper heat distribution and digesting liquid distribution in the chips, the digesting liquid introduced by pipe 38 is introduced a distance J below the bottommost portion of the lower portion 19 of the vessel 18, the distance J being a significant distance, at least equal to ½E (that is at least equal to the radius of the vessel 22). As an optimum, if E is 15 ft., J should be about 12 ft. or 80% of E. The introduction of the digesting liquid by pipe 38 helps insure that there will be no "short-circuiting" of the digesting liquid—that is by-passing the chips column G and going directly into the outlets 20. A countercurrent flow between the digesting liquid and the chips column G established in vessel 22 is produced.

As cellulose material chips and the like move downwardly through the impregnation zone A into the digesting zone B, they form a chips column G being relatively high in the center, the point of entrance of vessel 18 into zone B, and tapering downwardly therefrom on all sides. The liquid may pass through the top surface of chips column G, while the chips are retained in the column G. The annular area 28 in vessel 22 above the column G acts as a clarifier or stilling well, and in conjunction with the baffles 24 provides for even treatment of the chips with digesting liquid without the necessity for screens in front of outlets 20. The diameters D and E and the amount of digesting liquid introduced into vessel 22 are so gauged that the velocity of liquid flowing through portions of chips column G toward the outlets 20 is in the area of 5 feet/min., while the velocity that is necessary to entrain the chips particles in the liquid flow for movement upwardly therewith is approximately 50 feet/min. The perforated plates 26 prevent the entry of any large floatables into the outlet nozzles 20, and there is no reason to provide any screens in front of the outlet nozzles 20 since very few chips will be moved with the liquid upwardly past the upper surface of column G to the area 28.

In order to further insure that no channeling takes place, and to provide an assist in preventing clogging of the perforated plates 26 (which have little tendency to clog), a remotely controlled valve system 42 is provided comprising a plurality of valves 44, one valve 44 disposed in each line 45 leading from line 39 to an outlet nozzle 20. A remote control means 47 or the like—which also preferably controls the valves 34—is provided and operates the valves 44 in conjunction with the valves 34 so that for one of the outlet nozzles 20 during the operation of the assembly 10, liquid flows from the heater 36, through line 37 to the nozzle 20 and is forced into the area 28 through the nozzle 20. This provides a backwashing of the plate 26 associated with the nozzle 20, and for the whole area defined by the two baffles 24 associated with the nozzle 20. The backwashing maintains the desired future flow in the flow area, and clears the flow area of collected material. Since the liquid is always being extracted in more than one different direction, there is no tendency for the liquid to establish a channel through the pulp in flowing to an outlet, and thus uniform treatment of the pulp is insured.

A typical method of operation of the apparatus 10 according to the present invention is as follows: Wood chips are fed from steaming vessel 12 to charging means 14, and into the impregnation zone A of the digester 16. The chips flow downwardly through the vessel 18 which defines the impregnation zone A into the vessel 22, and establishes a chips column G in the vessel 22. Digesting liquid is introduced into the digesting zone B of vessel 22, as through inlet pipe 38, and the liquid flows upwardly through the chips column G into the outlets 20 under the suction provided by pump 32. Since at least three separate outlet channels are defined by the outlet nozzles 20 and associated baffles 24 extending into the area of vessel 22 below the lower portion 10 of the vessel 18, the liquid is pulled in several different directions, and thus the possibility of a channel being formed through the chips column G is minimized. Also, a valve 44 associated with one outlet 20 is preferably open at all times, while the valve 34 associated with that outlet 20 is closed, whereby liquid flows from the heater 36 through the outlet nozzle 20 and backflushes the flow area associated therewith, insuring future evenness of the flow into the flow area and removing any accumulated material therefrom. The control means 47 periodically changes the outlet nozzle 20 through which the fluid is being backflushed by closing the valve 44 associated therewith, and opening the valve 34 associated therewith, and simultaneously opening the valve 44 and closing the valve 34 associated with another outlet nozzle 20. Thus, even distribution of liquid through the chips column G is provided.

The liquid passing through outlet nozzles 20 flows into heater 36 under the force of pump 32, and returns through inlet pipe 38 which is preferably disposed a distance J into the chips column G. After passing through the digesting zone B, the liquid flows into a further treatment zone C, such as a washing zone. Eventually, the treated chips exit the digester 16 through the chips outlet 50 disposed adjacent the bottom thereof.

While the invention has been herein described with particular reference to the digesting zone of a continuous digester, it is to be understood that the screenless treatment and channeling-preventing features of the present invention are equally applicable to the washing zone or other process zones of a continuous digester, or for other process steps in other equipment. For instance, in the zone C, an annular space could be provided around an inner vessel member, and baffles could be provided in the annular space with an outlet nozzle associated with the area between each set of baffles, instead of the conventional screening arrangement 52 shown in FIG. 1. Many other modifications are also possible; thus, while the invention has been herein shown and described in what is presently conceived to be the most practical and preferred embodiment of the invention, many modifications may be made thereof within the scope of the invention, which scope is to be accorded the broadest interpretation of the appended claims so as to encompass all equivalent structures and methods.

What is claimed is:

1. A method for treating cellulose fiber material utilizing an inner vertically extending vessel having a diameter D and an outer vertically extending vessel having a diameter E greater than D, and a bottom portion of the inner vessel extending into the outer vessel and defining an annular liquid-filled space in the outer vessel between the innner vessel and the outer vessel, said method comprising the steps of passing cellulose fiber material through said inner vessel into said outer vessel to establish a column of cellulose fiber material extending downwardly from the bottom portion of the inner vessel, introducing cellulose fiber material treating liquid into said material column for treatment of said material, preventing channeling of liquid flow through said column by establishing at least three distinct stationary flow areas of fiber material treating liquid through said column to the annular space in the outer vessel, at least two of the three distinct stationary flow areas having liquid being withdrawn therethrough from the column through the annular space, and at least one of the flow areas not having liquid being withdrawn therethrough, withdrawing the liquid through the flow areas from the annular space in the outer vessel at a rate, relative to the dimensions of the vessels, such that a stilling well effect is created in said annular space and fiber material from said column is not entrained in liquid flow in said annular space and so that no screening of the liquid flow is necessary;

forcing liquid back into said annular space through one of said flow areas while withdrawal of liquid takes place through at least two flow areas; and continuously switching which of the flow areas liquid is forced back into.

2. A method as recited in claim 1 wherein said step of establishing at least three distinct flow areas is accomplished by providing at least three baffles extending through said annular space past the lower portion of said inner vessel in said outer vessel, a separate outlet nozzle being associated with each of said flow areas defined by adjacent baffles.

3. A method as recited in claim 1 comprising the further step of introducing said cellulose fiber material treating liquid into said material column at a distance J below the inner vessel bottom portion, said distance J being equal to or greater than $\frac{1}{2}$E.

4. A method as recited in claim 1 comprising the further step of heating the liquid withdrawn from the annular space and reintroducing it into said material column.

5. A method as recited in claim 1 wherein said fiber material treating liquid is digesting liquor, and wherein said outer vessel defines a continuous digester cooking zone.

6. A method as recited in claim 1 wherein said fiber material treating liquid is washing liquid, and wherein said outer vessel defines a washing zone.

7. A method as recited in claim 1 wherein said step of establishing at least three distinct flow areas is accomplished by providing at least three baffles extending through said annular space into the column of cellulose fiber material.

8. Apparatus for the treatment of cellulose fiber material comprising an inner vertically extending vessel having a diameter D;

an outer vertically extending vessel having a diameter E wherein E is larger than D;

a bottom portion of said inner vessel extending into said outer vessel and defining an annular liquid filled space in said outer vessel between said inner vessel and said outer vessel;

means for introducing cellulose fiber material treating liquid into a column of fiber material in said outer vessel;

means for drawing liquid introduced into said column in said outer vessel from said annular space to an area remote from said vessel, said means including a pump; and means for preventing channeling of liquid through said column, said means comprising: at least three vertically extending stationary baffles disposed in said annular space and partitioning said annular space into at least three distinct flow areas; a stationary outlet nozzle associated with each of said at least three distinct flow areas; means for operatively connecting each of said outlet nozzles to said liquid withdrawing means; means for selectively providing backflushing of a selected outlet nozzle and a flow area associated therewith while liquid is being drawn through the other outlet nozzles, said means including valve means, a valve means associated with each outlet; remote control means for operating said valve means and so that one outlet nozzle is being backflushed at all times and so that the outlet nozzle that is being backflushed is periodically changed.

9. Apparatus as recited in claim 2 wherein said valve means comprises a first valve means disposed in said means for operatively connecting each of said outlet nozzles to said liquid withdrawing means, a first valve means associated with each connecting means, and wherein a return line is provided for each outlet nozzle extending between said line leading from said heater to said liquid introducing means and said connecting means, and wherein said valve means comprises a second valve means disposed in each of said return lines; and wherein said remote control means operates each of said first and second valve means.

10. Apparatus as recited in claim 8 wherein each of said baffles extends through said annular space past the lower portion of said inner vessel in said outer vessel.

11. Apparatus as recited in claim 8 wherein a column of cellulosic fiber material is established in said outer vessel, and wherein each of said baffles extends through said annular space into said column.

12. Apparatus as recited in claim 8 wherein said pump is operatively connected to a heater, and wherein a line leads from said heater to said means for introducing cellulose fiber material treating liquid into said outer vessel.

13. Apparatus as recited in claim 8 further comprising a perforated plate associated with each outlet nozzle for preventing large floatables from passing into each outlet nozzle.

14. Apparatus as recited in claim 8 wherein said means for introducing cellulose fiber material treating liquid into a column of fiber material in said outer vessel comprises an inlet pipe extending downwardly through said inner vessel into said outer vessel, and having an opening disposed a distance J into said outer vessel from the bottom portion of said inner vessel, said distance J being equal to or greater than $\frac{1}{2}$E.

15. Apparatus as recited in claim 8 wherein said inner vessel defines a cellulose fiber material impregnation chamber, and wherein said outer vessel defines a cellulose fiber material digesting chamber.

* * * * *